United States Patent [19]

Iwamoto et al.

[11] Patent Number: 5,071,111

[45] Date of Patent: Dec. 10, 1991

[54] DRIVING DEVICE FOR A ROTATABLE CASSETTE

[75] Inventors: Kenichi Iwamoto; Yuji Sugimoto; Toyoaki Namba; Masakatsu Itoigawa, all of Nara; Yoshihumi Shibano, Yamatokoriyama; Kenzi Okada, Ikoma, all of Japan

[73] Assignee: Sharp Kabushiki Kaisha, Osaka, Japan

[21] Appl. No.: 521,839

[22] Filed: May 10, 1990

[30] Foreign Application Priority Data

May 15, 1989 [JP] Japan ..... 1-121809
May 15, 1989 [JP] Japan ..... 1-121810
May 15, 1989 [JP] Japan ..... 1-121811
May 15, 1989 [JP] Japan ..... 1-121813

[51] Int. Cl.[5] ..... B65H 1/08
[52] U.S. Cl. ..... 271/145; 271/127
[58] Field of Search ..... 271/126, 145, 147, 157, 271/158, 162, 164, 171, 127, 241, 253–255

[56] References Cited

U.S. PATENT DOCUMENTS 4,602,884 7/1986 Stickel ..... 271/162 X
4,637,601 1/1987 Costa et al. ..... 271/127 X

FOREIGN PATENT DOCUMENTS 56-59245 5/1981 Japan .
56-59251 5/1981 Japan .
58-192836 12/1983 Japan .
59-123859 7/1984 Japan .
262735 12/1985 Japan ..... 271/145
61-58374 3/1986 Japan .

*Primary Examiner*—D. Glenn Dayoan
*Assistant Examiner*—Boris Milef

[57] ABSTRACT

A feeding device in accordance with the present invention includes an arm mounted such that one edge thereof is rotatably supported and is capable of moving freely in the horizontal plane, a rotating section rotatably supported by the other edge of the arm and is capable of rotating freely in the horizontal plane to at least two paper feed positions, i.e. longitudinal and lateral feed positions, and a pivotal paper holding plate that is capable of rising. A rotating device is rotatably mounted in the vicinity of a corner of the rotating section and moves back and forth in a straight line in a direction orthogonal to the paper feed direction and permits the rotating section to rotate. A flexible joint is provided which is capable of pivoting in at least two directions and supports the pivotal paper holding plate at one point located in the corner formed by a non-feeding side of the rotating section when the rotating section is set in the longitudinal feed position and the non-feeding side of the rotating section when the rotating section is set in the lateral feed position, such that the pivotal paper holding plate uses the non-feeding side of the rotating sections as fulcrums when the pivotal paper plate pivots and rises.

21 Claims, 13 Drawing Sheets

31
31a
31b
32
32a
33
33a
33b
33c
33e
33f
34
34a
34b
34c
34d
34f
34g
34h
35
36
37
40
41
41a
42
43
44
44a
45
46
47
48
50
50a
50b
51
52
52a
52b
53
53a
53b
54
55
55a
55b
56
56b
57
57a
58
58a
58b

DRIVING DEVICE FOR A ROTATABLE CASSETTE

BACKGROUND OF THE INVENTION

1. Field of the Invention

The present invention relates to a driving device for rotatable cassette to be used for feeding copy material longitudinally or laterally at will, such as for example a driving device used in copying machines, laser printers, over-head projectors and other apparatuses. To be precise, the present invention relates to a feeding device comprising a supporting device for supporting a pivotal copy material holding plate used for raising the copy material stored in the rotatable cassette.

2. Description of Related Art

In the conventional art, for example in a copying machine, there is installed a paper feeding device that supplies copy paper to the main body of the copying machine, and that is provided with a plurality of paper feeding cassettes for each copy paper size. For conveying the copy paper from the paper feeding device, lateral feed where the transport direction coincides with the crosswise direction of the copy paper, is preferred in terms of transport time to longitudinal feed where the transport direction coincides with the lengthwise direction of the copy paper. Some copying machines even laterally feed copy paper sheets of B4 and A3 sizes.

However, feeding large size copy paper laterally causes the photosensitive drum, the transport rollers, the transport path of the paper, and other parts inside the copying machine to become large. As a result the copying machine itself becomes large and bulky, and its cost rises. Hence generally, the method of longitudinally feeding copy paper of a large size such as A3 or B4, and laterally feeding copy paper of a size not larger than A4, is adopted.

However, with such an arrangement, in a copying machine provided with a variable magnification function that performs reductions and enlargements, for instance B5R and A4R paper feeding cassettes that feed the copy paper longitudinally, are necessary to perform reduced copies. In addition, when thinking of transport time, A4 and B5 paper feeding cassettes that feed the copy paper laterally, are also necessary. Accordingly, when it comes to installing those different types of paper feeding cassettes, either the paper feeding device has to be designed in a large size, or the paper feeding cassettes must be changed as occasion calls. This causes the size of the copying machine to be large and its cost to rise, or the operation of the copying machine to become complicated.

Hence, in order to avoid such a problem, an arrangement is suggested as disclosed in Japanese Publication for Unexamined Patent Application No. 59245/1981 and No. 59251/1981, (Tokukaisho No. 56-59245 and Tokukaisho No. 56-59251). Namely, a common paper feeding cassette is used both as B5 paper feeding cassette and B5R paper feeding cassette, and a common paper feeding cassette is used both as A4 paper feeding cassette and A4R paper feeding cassette. The copy paper is fed laterally or longitudinally by changing the feed position of the copy paper stored in the paper feeding cassettes.

However, with the above conventional arrangement, when the feed position of the copy paper stored in the paper feeding cassette is changed, the distance separating the paper feeding cassette and a pick-up roller differs when the copy paper is placed in the lateral feed position and when the copy paper is placed in the longitudinal feed position. Consequently, after the feed position of the copy paper stored in the paper feeding cassette is shifted to the lateral feed position, either the paper feeding cassette has to be brought close to the pick-up roller, or the pick-up roller has to be brought close to the paper feeding cassette. This means that in addition to the device for changing the feed position of the copy paper, a motion device for moving the paper feeding cassette or the pick-up roller needs to be installed, thereby causing the structure to become complex and expensive. Moreover as it takes time for the motion device to move the paper feeding cassette or the pick-up roller, the copy paper cannot be fed rapidly. Specially, when the motion device is arranged such that the pick-up roller is moved, the transport path of the copy paper gets longer as the leading edge of the copy paper placed in the lateral feed position recedes as compared to when the copy paper is placed in the longitudinal feed position. Therefore, the advantages that were obtained by changing the feed position of the copy paper stored in the paper feeding cassette are reduced by half.

Moreover, with the conventional arrangement, in order to forward the copy paper stacked in the paper feeding cassette by means of the pick-up roller, the topmost copy paper sheet needs to be raised to a position where it can be in contact with the pick-up roller. As means that responds to this requirement, there is known the device of the above publication, as well as, adapted not to a rotatable cassette but to a fixed cassette, for example a device as disclosed in Japanese Publication for Examined Patent Application No. 58374/1986 (Tokukosho No. 61-58374).

When in order to lift the copy paper, a pivotal paper holding plate whereon the copy paper is stacked pivots in the vertical direction, the angle by which the pivotal paper holding plate is lifted increases as the amount of remaining copy paper decreases. As the angle by which the pivotal paper holding plate is lifted increases, the forwarding direction of the copy paper stacked on the pivotal paper holding plate is shifted with respect to a feeding mechanism constituted by the pick-up roller and other members. The above publication discloses a device in which in a fixed cassette, with an inclined part declining forwards, is accommodated in the paper feeding section of the pivotal paper holding plate. However, such an inclined Part is not provided in a pivotal paper holding plate of the rotatable cassette and as mentioned earlier the forwarding direction of the copy paper stacked on the pivotal paper holding plate is shifted with respect to the feeding mechanism.

In order to forward the copy paper stacked in the paper feeding cassette with the pick-up roller, the topmost copy paper sheet needs to lifted to a position where it can be in contact with the pick-up roller. As means to respond to this requirement, in addition to the device disclosed in the above publication there is also known a device as disclosed in Japanese Publication for Unexamined Utility Model Application No. 192836/1983 (Jitsukaisho No. 58-192836). The supporting structure involved is constituted by a pivotal paper holding plate whereon copy paper is stacked, that is merely placed inside a paper feeding cassette. The pivotal paper holding plate has a longitudinal paper feeding section and a lateral paper feeding section. When lifting each paper feeding section of the pivotal paper holding plate, use has been made of the fact that each non-feeding section naturally forms the fulcrum about which the pivotal paper holding plate pivots, and the lateral wall of the paper feeding cassette serves as a guide during the pivoting process.

However, with the structure described above, a shift in the position of the pivotal paper holding plate (shift in the horizontal direction) is likely to occur. For instance, when the copy paper is shifted with respect to the paper feed direction, the position of the leading edge of the copy paper is shifted thereby causing the distance between the copy paper and the pick-up roller to be disparate. Besides, a shift of the copy paper with respect to the direction orthogonal to the paper feed direction causes the center of the copy paper to be shifted. Furthermore, when the pivotal paper holding plate is moved in the horizontal plane, the copy paper is sent slantwise which might cause a hindrance to the paper feeding process.

SUMMARY OF THE INVENTION

An object of the present invention is to avoid feeding copy material whose position is shifted, when supplying copy material after a pivotal copy material holding plate is pivoted and raised.

Another object of the present invention is to assure a smooth and reliable shift of the cop material feed position and to assure that the leading edge of the copy material is always placed in the same position when the copy material is set in different feed positions, without causing the apparatus to be large and bulky, or its operation to be complex.

In order to achieve the above objects, the present invention comprises:

an arm that is arranged such that the shaft of one of its edges is rotatably supported by a given member and that is capable of moving freely in the horizontal plane, copy material orientation changing means whose shaft is rotatably supported by the other edge of the arm and that is capable of moving freely in the horizontal plane to at least two feed positions, i.e. longitudinal feed position and lateral feed position, and a moving member that is rotatably mounted in the proximity of a corner of the copy material orientation changing means and that moves linearly back and forth in a direction orthogonal to the copy material feed direction.

With the above arrangement, the copy material orientation changing means moves in response to the linear motion back and forth of the moving member and is set in the desired feed position. As the moving member moves linearly during the motion of the copy material orientation changing means, the leading edge of the copy material is always placed in the same position when the copy material is set in the longitudinal feed position and when the copy material is set in the lateral feed position. As a result, the need for a device for moving the feeding cassette, the pick-up roller or other parts is eliminated, and the structure simplified. In addition, as the copy material orientation changing means and the moving member are coupled and as the moving member moves linearly, the copy material orientation changing means is moved to the desired feed position through the circular arc motion of the arm.

In order to achieve the above objects, the present invention further comprises a pivotal copy material holding plate that is:

supported at one point by a flexible joint that is capable of pivoting in at least two directions so that the copy material feeding sections for the longitudinal feed and lateral feed raise using their respective non-feeding sections as fulcrums, and composed of 3 parts, namely a carrying part where copy materials are stacked, a first inclined part declining forward or capable of declining forward, and accommodated in the longitudinal copy material feeding section, and a second inclined part declining forward of, capable of declining forward, and accommodated in the lateral copy material feeding section.

With the above arrangement, the copy material stacked on the pivotal copy material holding plate may be forwarded in a suitable feed direction that fits the feeding mechanism even when the pivotal copy material holding plate is raised, and the feed operation of the copy materials may be executed in good condition after the pivotal copy material holding plate is raised. The first inclined part accommodated in the longitudinal copy material feeding section, and the second inclined part accommodated in the lateral copy material feeding section may be designed such as to have tilt angles that are most suitable for feeding the copy material. Namely, during the lateral feeding, as the transport direction coincides with the short side direction of the copy material, the tilt angle of the pivotal copy material holding plate needs to be increased whereby the tilt angle of the inclined part needs to be increased too. In the present invention, the first inclined part whose tilt angle may be small, is fabricated through for example a bending process, while the second inclined part whose tilt angle is large is constituted by an inclined plate connected to the carrying part by a hinge. Optimum tilt angles may be thus secured without causing the manufacturing process of the pivotal copy material holding plate to be complex. When both inclined parts have mutually equal lengths, undesirable consequences arise, i.e. the second inclined part whose tilt angle is large protrudes downwards causing only one side of the pivotal copy material holding plate to be in contact with the member installed below the pivotal copy material holding plate and the pivotal copy material holding plate to be as floating. However, with the present invention, as the second inclined part is composed of an inclined plate connected to the carrying part by a hinge, when the pivotal copy material holding plate is not in a raised state, the lower edges of both inclined parts are located in the same plane. The condition where the pivotal copy material holding plate is as floating can be thus avoided. In addition, if each of the inclined parts is composed of an inclined plate connected to the carrying part by a hinge, the carrying part and the first and second inclined parts are aligned in the same plane when the pivotal copy material holding plate is not in a raised state. The bottom of the pivotal copy material holding plate thus does not have to be in an elevated state and may be accommodated in a flat shape, enabling a greater quantity of copy material to be stored.

In order to achieve the above objects, the present invention further comprises guiding means for serving as a guide to the pivotal copy material holding plate while one of the copy material feeding sections of the pivotal copy material holding plate is being lifted up, for serving as a fulcrum for the pivotal copy material plate when the other copy material feeding section is being lifted up, and that is composed of a guide bar accommodated horizontally on one non-feeding side of the pivotal copy material holding plate that is fitted in long holes formed on a sustaining member and extending vertically.

With the above arrangement, shifts in the position of the pivotal copy material holding plate (shift in the horizontal direction) may be prevented by a supporting member that supports the pivotal copy material holding plate at one point, and the copy material may be prevented from being fed in a shifted position during the feed operation performed after the pivotal copy material holding plate was lifted up. In addition, the guiding means prevents the pivotal copy material holding plate from moving in the horizontal plane and reduces the number of defective feeds by preventing the copy material from being fed slantwise. Also the guiding means enables the pivotal copy material holding plate to pivot smoothly and accurately.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a perspective view illustrating the driving device of a rotatable cassette;

FIG. 2 is a perspective view of a pivotal paper holding plate;

FIG. 3 is a front view illustrating schematically the inner arrangement of a copying machine;

FIG. 4 is a perspective assembly drawing illustrating the supporting member of the pivotal paper holding plate;

FIG. 5 is a cross-sectional view illustrating the supporting member of the pivotal paper holding plate;

FIG. 6 is a plan view illustrating a feeding mechanism;

FIG. 7(*a*) is a side view of the feeding mechanism;

FIG. 7(*b*) is a side view illustrating a situation where a paper pushing back member and other members shown in FIG. 7(*a*) are in action;

FIGS. 8 (*a*) through (*d*) are plan views illustrating the rotation process of a rotating section;

FIG. 9 is a perspective view illustrating an example of a second inclined part for the pivotal paper holding plate;

FIG. 10 is a side view illustrating the main parts composing a stopper; and

FIG. 11 is a perspective view illustrating an example of a first inclined part and the second inclined part for the pivotal copy material holding plate.

DESCRIPTION OF THE PREFERRED EMBODIMENTS

An embodiment of the present invention will be described hereinbelow with reference to FIG. 1 through FIG. 11.

Figure 3:
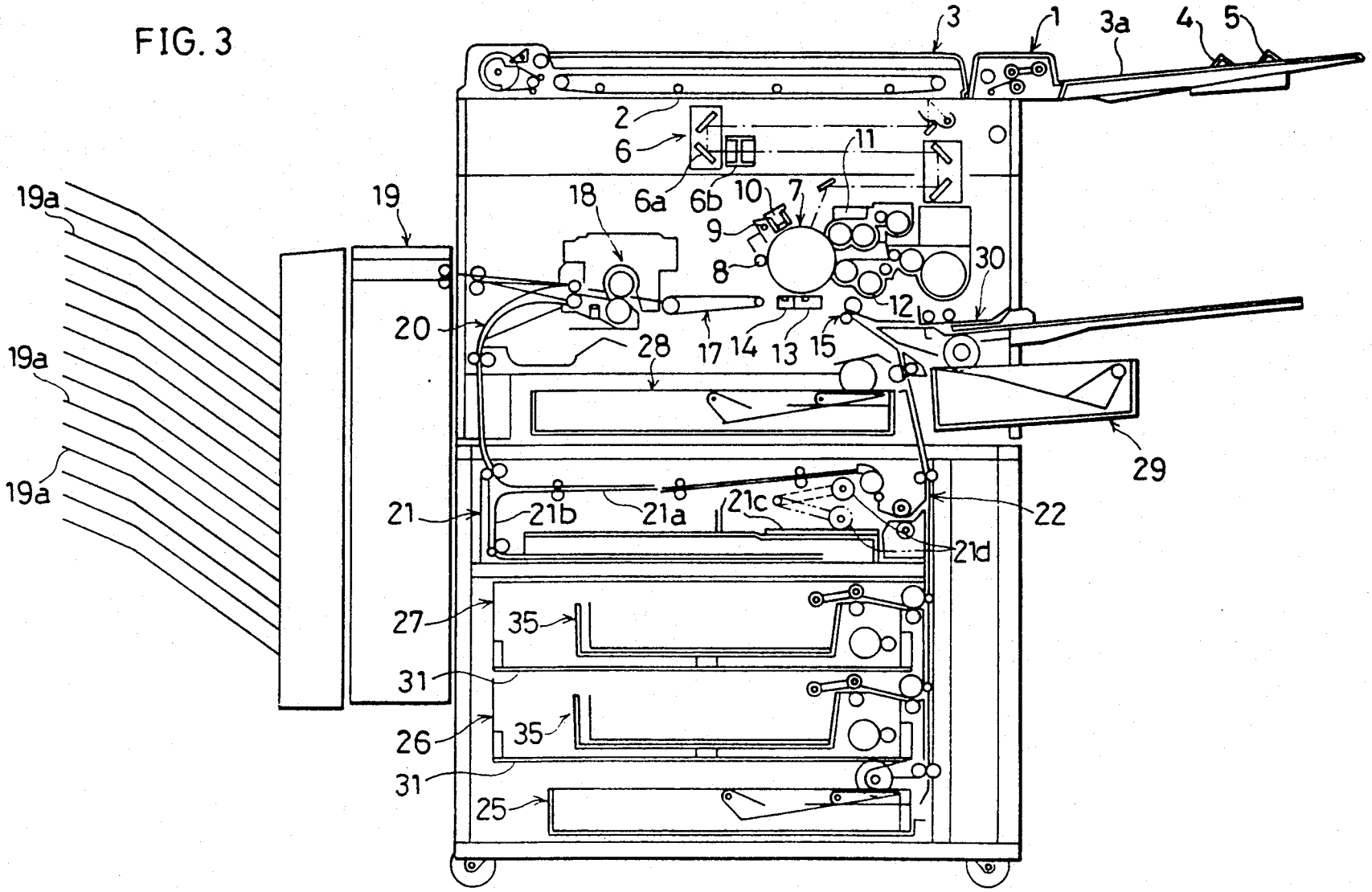

As illustrated in FIG. 3, an automatic document feeder 3 (hereinafter referred to as ADF) is mounted on the document glass plate 2 of a copying machine 1. The ADF 3 is provided with functions for carrying a document, not shown, that was placed on a document tray 3*a*, onto a predetermined position on the document glass plate 2 in accordance with the size and feed direction (lateral feed or longitudinal feed) of the document, for discharging the document outside the ADF 3 after completion of the copy, and in addition, when for example both sides of the document are to be copied, for turning over the document, conveying it again to the predetermined position on the document glass plate 2, and discharging it outside the ADF 3 after completion of the copy. In addition, detection switches 4 and 5 are installed on the document tray 3*a* for determining the size of document that was placed thereupon.

An optical system 6 composed of a plurality of reflecting mirrors 6*a* and a plurality of lenses 6*b*, is disposed below the document glass plate 2. In addition to the basic function for leading an optical image to a photosensitive drum 7, the optical system 6 also has a magnification function that permits full size copying, as well as enlarged and reduced copying.

In the periphery of the photosensitive drum 7, there are placed a cleaner 8, a static eliminating charger 9, an electrostatic charger 10, a developing device 11 provided with toner for color copying, and a developing device 12 provided with black toner. The following sequence of operations is performed on the photosensitive drum 7 by the above means: removal of the remaining toner, static elimination, electrostatic charge, exposure (executed by the optical system 6) and development.

Below the photosensitive drum 7, there are installed a transferring charger 13 and a separating charger 14. Provision is made such that a toner image that was formed on the photosensitive drum 7 is transferred on copy paper (copy material), not shown, by means of the transferring charger 13 when the copy paper passes between the photosensitive drum 7 and the transferring charger 13. The copy paper is separated from the photosensitive drum 7 by means of the separating charger 14 and conveyed by a conveyor belt !7 to a fixing device 18 that fixes the toner image transferred on the copy paper through heat and pressure.

Basically, after it passed through the fixing device 18, the copy paper is discharged outside the copying machine 1, that is, goes through a sorter 19 and is discharged on discharge trays 19*a*. However, for example during the duplex or composite copying, the copy paper passes through a paper return path 20 and is led to a duplex/composite unit 21. During the duplex copying, the copy paper passes through a first transport path 21*a* inside the duplex/composite unit 21, is turned over and placed on an intermediate tray 21*c*, and is sent by a delivery roller 21*d* in a paper feeding path 22. On the other hand, during the composite copying, the copy paper is sent to a second transport path 21*b* inside the duplex/composite unit 21, where the trailing edge of the copy paper is detected and the copy paper is conveyed in the reverse direction. The copy paper passes through the first transport path 21*a* and is turned over and placed on the intermediate tray 21*c*. The copy paper is then sent to the paper feeding path 22 by the delivery roller 21*d*.

The paper feeding path 22 is the path that directs the copy paper to the photosensitive drum 7. At the end of the paper feeding path 22, there is installed a paper stop roller 15 for synchronizing the feed of the copy paper and the rotation of the photosensitive drum 7. A plurality of paper feeding means are connected to the paper feeding path 22, and provision is made such that the copy paper is properly fed from these paper feeding means. Concretely, there are installed in order from the bottom of the copying machine a first fixed cassette 25, a first rotatable cassette 26, a second rotatable cassette 27, the duplex/composite unit 21, a second fixed cassette 28, a third fixed cassette 29 and a manual paper feeder 30. The first fixed cassette 25, the second fixed cassette 28 and the third fixed cassette 29 are detachable from the copying machine 1, and the first rotatable cassette 26 and the second rotatable cassette 27 may be drawn out from the copying machine 1 together with a baseplate 31.

Figures 1, 2:
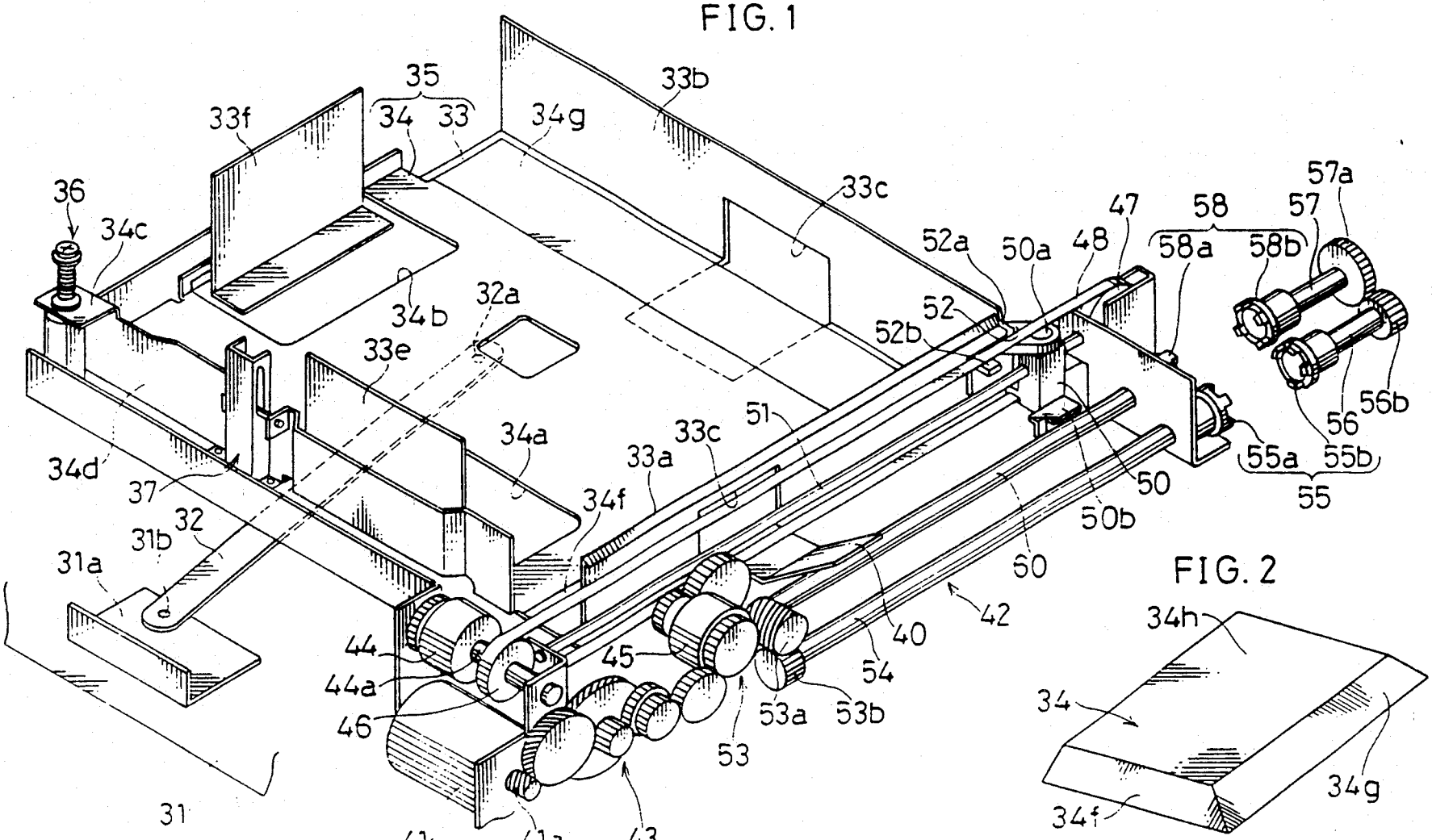
FIGS. 1 through 11 are views illustrating an embodiment of the present invention.

As illustrated in FIG. 1, a seat 31*a* is fixed on the baseplate 31 that forms a basket portion in the first rotatable cassette 26 and the second rotatable cassette 27. An edge of an arm 32 is rotatably supported by a pivot pin 31*b* that is mounted vertically on the seat 31*a* and that permits the arm 32 to rotate in a horizontal plane. A pivot pin 32*a* is mounted vertically at the other edge of the arm 32 and rotatably supports a rotating section 35 (copy material orientation changing means). The rotating section 35 is composed of two plates, i.e. a paper feeding base 33 (copy material feeding base) and a pivotal paper holding plate 34 that is placed upon the paper feeding base 33. The feed of the copy paper stacked on the pivotal paper holding plate 34 can be freely switched to the longitudinal feed or the lateral feed by rotating the rotating section 35 by 90° in the horizontal plane. The position where the rotating section 35 is rotatably supported by the pivot pin 32*a* is designed such that the center of the copy paper is positioned upon the pivot pin 32*a* when the copy paper is set in the lateral feed position as well as when the copy paper is set in the longitudinal feed position.

Walls 33*a* and 33*b* are formed by bending in the longitudinal paper feeding section (longitudinal copy material feeding section) and the lateral paper feeding section (lateral copy material feeding section) of the paper feeding base 33 in order to prevent the stacked copy paper from slipping off. Approximately in the center of each of the walls 33*a* and 33*b* there is formed an opening 33*c*. Each opening 33*c* further extends in the bottom plate of the paper feeding base 33 and penetrates toward the center of the bottom plate for a predetermined length. A lift member 40 that is disposed below the paper feeding base 33, is in contact with the outer face of the bottom plate of the pivotal paper holding plate 34. The configuration of the lift member 40 will be described in detail later.

Walls 33*f* and 33*e* are disposed on the paper feeding base 33 in such a fashion that they face respectively the walls 33*a* and 33*b*. Walls 33*f* and 33*e* are respectively mounted such as to pass through openings 34*b* and 34*a* that are formed on the pivotal paper holding plate 34 and such as not to interfere with the lifting operation of the longitudinal paper feeding section and the lateral paper feeding section of the pivotal paper holding plate 34.

As illustrated in FIG. 2 (in FIG. 2 the pivotal paper holding plate 34 is illustrated schematically and the openings 34*a* and 34*b* are omitted), the pivotal paper holding plate 34 is composed of three parts, i.e. a carrying part 34*h* where the copy paper is stacked, a first inclined part 34*f* formed in the longitudinal paper feeding section and declining forward, and a second inclined part 34*g* formed in the lateral paper feeding section and declining forward.

Figure 4:
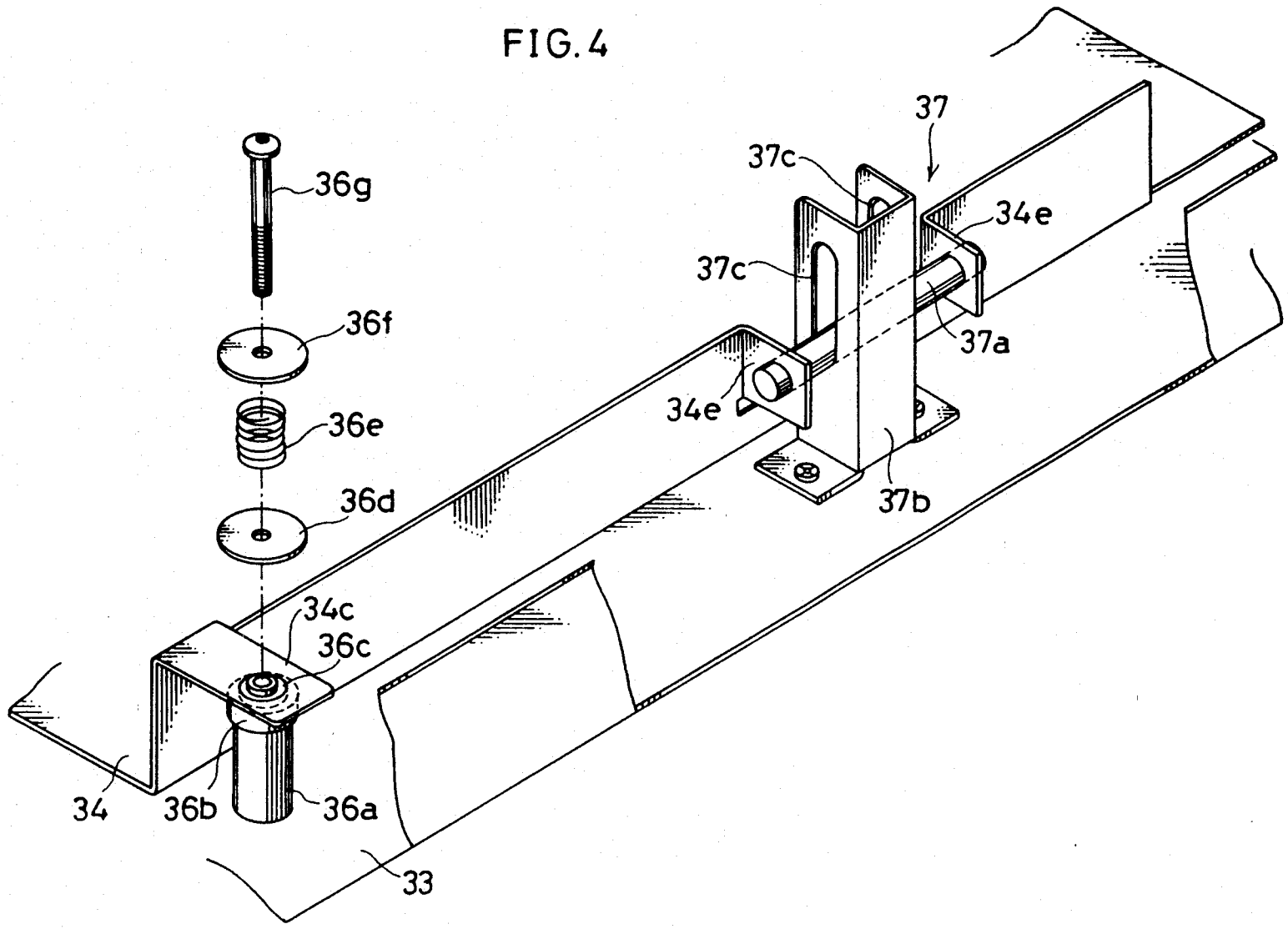
Figure 5:
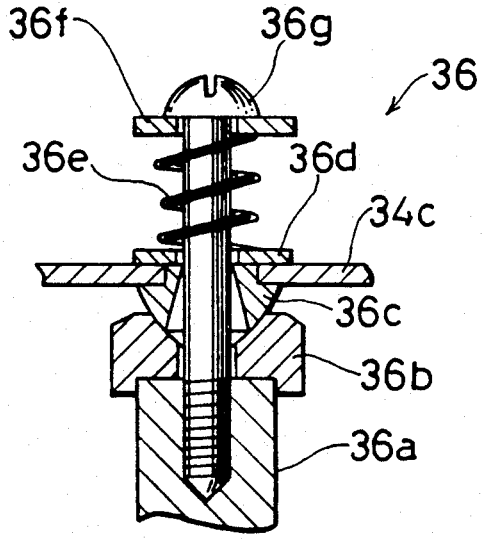

At the corner of the pivotal paper holding plate 34 formed by the non-feeding section that corresponds to the longitudinal paper feeding section and the non-feeding section that corresponds to the lateral paper feeding section, a supporting segment 34*c* is formed in a bent shape and extends outwards from the upper edge of the wall 34*d* of the pivotal paper holding plate 34. A supporting member 36 that supports one point of the pivotal paper holding plate 34 is accommodated on the supporting segment 34*c*. Comprised in the supporting member 36, as illustrated in FIG. 4 and FIG. 5 a cylindrical supporting member 36*a* is mounted vertically upon the paper feeding base 33, and a female joint 36*b* (flexible joint) is fixed on the upper edge of the cylindrical supporting member 36*a*. In the upper part of the female joint 36*b* there is formed a semi-spherical recession in which a male joint 36*c* (flexible joint) having a semi-spherical protrusion, is engaged. The female joint 36*b* and male joint 36*c* constitute a flexible joint that supports the pivotal paper holding plate 34 so that the pivotal paper holding plate 34 is free to rotate in at least two directions. In the upper portion of the male joint 36*c* there is formed an engagement part where the supporting segment 34*c* is engaged thereby permitting the pivotal paper holding plate 34 and the supporting member 36 to be coupled. A washer 36*d*, a coiled spring 36*e* and a washer 36*f* are disposed upon the male joint 36*c*. A bolt 36*g* is mounted so as to penetrate through the washer 36*f*, the coiled spring 36*e*, the washer 36*d*, the male joint 36*c*, and the female joint 36*b*, and is screwed in a threaded hole formed in the cylindrical supporting member 36*a*. The male joint 36*c* and the female joint 36*b* are maintained in contact by means of the coiled spring 36*e*. As the hole in the male joint 36*c* wherethrough the bolt 36*g* penetrates is formed in the shape of a circular cone that spreads downwards, the bolt 36*g* does not interfere with the articulated action of the male joint 36*c*.

Guiding means 37 is accommodated on a non-feeding side of the rotating section 35 and some distance apart from the supporting member 36 on the longitudinal feed forwarding side. The guiding means 37 serves as a guide for the pivotal paper holding plate 34, when the longitudinal paper feeding section of the pivotal paper holding plate 34 is being lifted up. The guiding means 37 also serves as a fulcrum for the pivotal paper holding plate 34 when the lateral paper feeding section of the pivotal paper holding plate 34 is being lifted up. The guiding means 37 is arranged such that a guide bar 37*a* (guide member) is disposed in a fixed manner between a pair of sustaining segments 34*e* that face each other and that are bent and formed by dividing the wall 34*d* of the pivotal paper holding plate 34 at a prescribed position. Meanwhile, a sustaining member 37*b* whose cross section is formed in the shape of a U, is mounted vertically on the feeding base 33 such that each opposite face of a pair of upright faces, faces one of the sustaining segments 34*e*. On the upright faces of the sustaining member 37*b*, there are formed vertically elongated shaped guiding long holes 37*c* (guiding hole) where the guide bar 37*a* is disposed such as to penetrate therethrough. Provision is made such that the rotation axis of the guide bar 37*a* when the guide bar 37*a* is positioned at the lower end of the guiding long holes 37*c*, coincides with the axis about which the flexible joint mentioned earlier pivots. That is, the flexible joint is positioned on the axis of the guide bar 37*a*.

Driving means 42 is mounted on the paper feeding section of the rotatable cassette 26 (27). The driving means 42 drives the rotating section 35 to rotate by 90° and drives the lift member 40 to pivot and execute the lifting operation of the copy paper stacked on the pivotal paper holding plate 34, by means of a single driving motor 41. The driving means 42 is designed such that a gear 41*a* is fixed on the output shaft thereof. The driving force of the driving motor 41 is transmitted to a first clutch 44 and a second clutch 45 through a group of gears 43 that are meshed with the gear 41*a*.

The first clutch 44 is installed on one side of the paper feeding section of the rotating section 35, and is used for the transmission of the driving force for rotating the rotating section 35 by 90°. A pulley 46 is fixed on the output shaft 44*a* of the first clutch 44, while a pulley 47 is mounted on the other side of the paper feeding section of the rotating section 35. An endless belt 48 is installed across the two pulleys 46 and 47. A moving block 50 is fixed on a predetermined portion in the lower section of the belt 48, and moves back and forth in response to the motion of the belt 48. Approximately in the central part of the moving block 50 there is formed a through hole wherethrough a guide shaft 51 that extends between the pulleys 46 and 47 in a direction orthogonal to the paper feed direction, passes. The motion of the moving block 50 is maintained in a straight line by means of the guide shaft 51. On the upper part of the moving block 50, there is formed a pivot pin 50*a* where a sustaining member 52 (moving member) is rotatably supported. The sustaining member 52 is accommodated with an angle 52*a* that is approximately in the shape of a L, and that is attached at the corner on the paper feeding base 33 formed by the longitudinal paper feeding section and lateral paper feeding section. A position sensing switch 100 (shown in FIG. 8) is installed in the proximity of one edge of the guide shaft 51, and is actuated when it is pressed by a switch actuating segment 52*b* that is fixed on the angle 52*a*. A position sensing switch 101 (shown in FIG. 8) is installed in the proximity of the other edge of the guide shaft 51, and is actuated when it is pressed by a switch actuating segment 50*b* located on the moving block 50.

The second clutch 45 is used for the transmission of the driving force for the lifting operation of the copy paper stacked in the pivotal paper holding plate 34. The output of the second clutch 45 is transmitted to a rotation shaft 54 through a group of gears 53. Namely, the output of the second clutch 45 is transmitted to a worm gear 53*a* comprised in the group of gears 53, further passes though a wheel gear 53*b* that is meshed with the worm gear 53*a*, and is transmitted to the rotation shaft 54 that is mounted at a level different from the level of the output shaft of the second clutch 45.

A coupling part 55*a* that constitutes one part of a first coupling 55, is fixed at the other edge of the rotation shaft 54, while a coupling part 55*b* that constitute the other part of the first coupling 55 is fixed at the leading edge of a rotation shaft 56 that is rotatably supported on the main body of the copying machine 1. A gear 57*a* that is fixed on a rotation shaft 57, is meshed with a gear 56*b* that is fixed on the rotation shaft 56. The rotation shaft 57 is parallel with the rotation shaft 56, and like the rotation shaft 56, is rotatably supported on the main body of the copying machine 1. On the leading edge of the rotation shaft 57, there is fixed a coupling part 58*b* that constitutes one part of a second coupling 58. A coupling part 58*a* that constitutes the other part of the second coupling 58 is fixed on an edge of a lift-up shaft 60 that is mounted in parallel with the rotation shaft 54. The coupling part 55*a* and the coupling part 55*b* that form the first coupling 55, and the coupling part 58*a* and the coupling part 58*b* that form the second coupling 58, engage and disengage as the rotatable cassette 26 (27) is pushed in and drawn out of the copying machine 1.

The lift member 40 described earlier is substantially fixed in the central portion of the lift-up shaft 60. Provision is made such that the lift member 40 pivots and lifts the paper feeding section of the pivotal paper holding plate 34 in response to the rotation of the lift-up shaft 60. The other edge of the lift-up shaft 60 is simply supported rotatably and is not connected to any other member. Consequently, when the coupling part 58*a* and the coupling part 58*b* are disengaged, the lift-up shaft 60 is completely free causing the lift member 40 that is lifting the pivotal paper holding plate 34, to pivot downwards due to its own weight.

Figure 6:
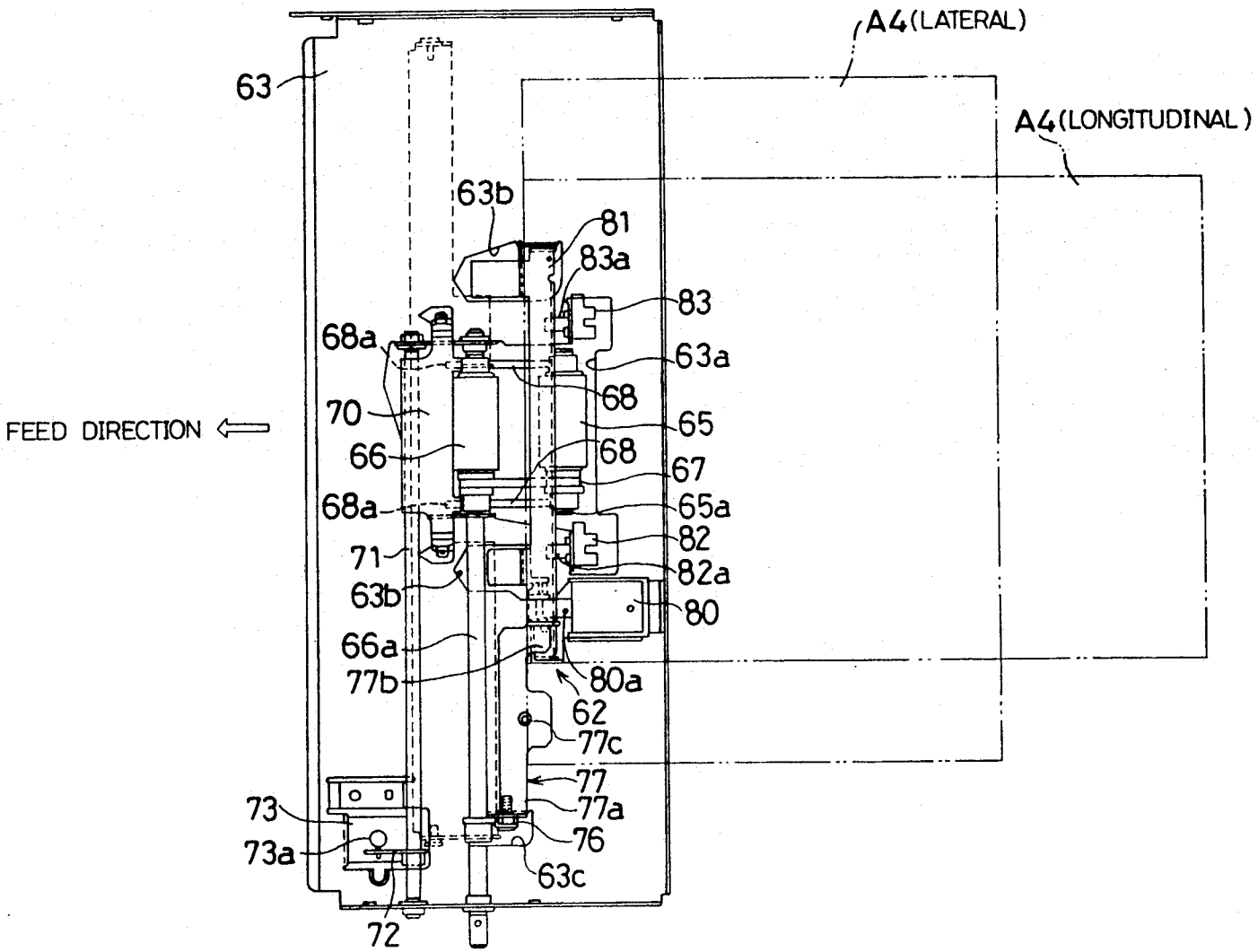

As illustrated in FIG. 6, a supporting board 63 is fixed to the main body of the copying machine 1 and is accommodated over the paper feeding section of the rotating section 35. A feeding mechanism 62 for forwarding the copy paper in the paper feeding path 22, is installed on the supporting board 63. An opening 63*a* formed such that a pick-up roller 65 and a portion of a feeding roller 66 of the feeding mechanism 62 protrude downwards from the supporting board 63, an opening 63*b* formed such that a portion of a paper pushing back member 81 protrude from the supporting board 63, and an opening 63*c* formed such that a portion of a pressure release lever 76 protrude downwards from the supporting board 63, are respectively accommodated on the supporting board 63.

In the feeding mechanism 62, the pick-up roller 65 is installed and positioned over the paper feeding section of the rotating section 35, while the feeding roller 66 is mounted so as to be in parallel with, juxtaposed to and separated by a given distance in the feed direction with the pick-up roller 65. The two rollers 65 and 66 are rotated in the same direction through an endless belt 67 that runs across one edge of each of the two rollers 65 and 66. A pair of roller arms 68 is accommodated across a supporting shaft 65*a* that supports the pick-up roller 65 rotatably, and a rotation shaft 66*a* that transmits the rotation force to the feeding roller 66, so as to embrace the two rollers 65 and 66. The two roller arms 68 pivot using the rotation shaft 66*a* as a fulcrum, thereby permitting the pick-up roller 65 to rise and lower, and enter in contact with or to withdraw from the copy paper.

A protrusion 68*a* is formed on each roller arm 68 at the edge located on the feeding roller 66 side. The protrusions 68*a* are pushed downwards by a feed actuating angle 70 causing the roller arms 68 to pivot upwards. The feed actuating angle 70 is fixed to one edge of a feed actuating shaft 71, and pivots in response to the rotation of the feed actuating shaft 71

A solenoid coupling member 72 is attached on the other edge of the feed actuating shaft 71. An actuating shaft 73*a* is connected to a long hole that is formed at the leading edge of the solenoid coupling member 72. The progressing and recessing action of the actuating shaft 73*a* is converted by means of the solenoid coupling member 72 into a rotation action of the feed actuating shaft 71.

Figure 7A:
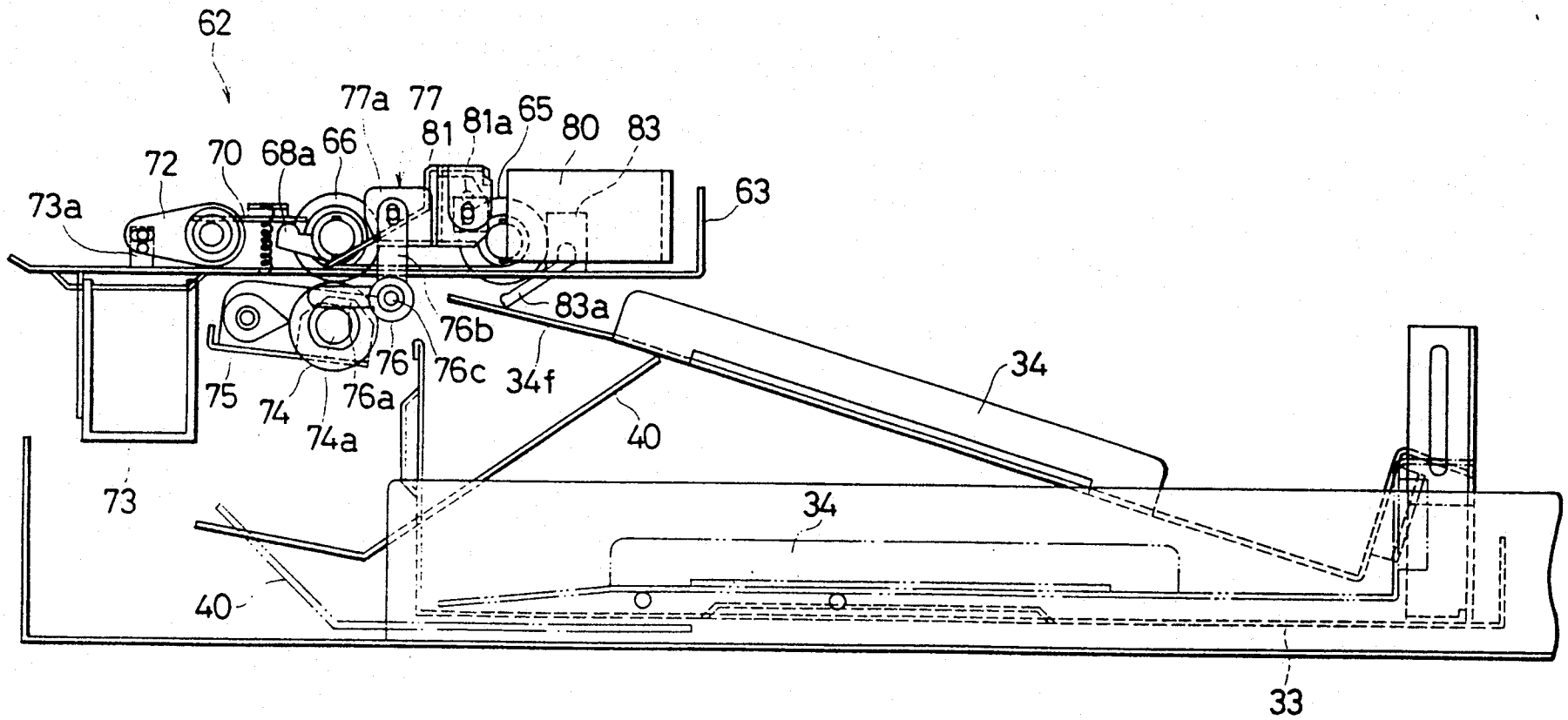
Figure 7:
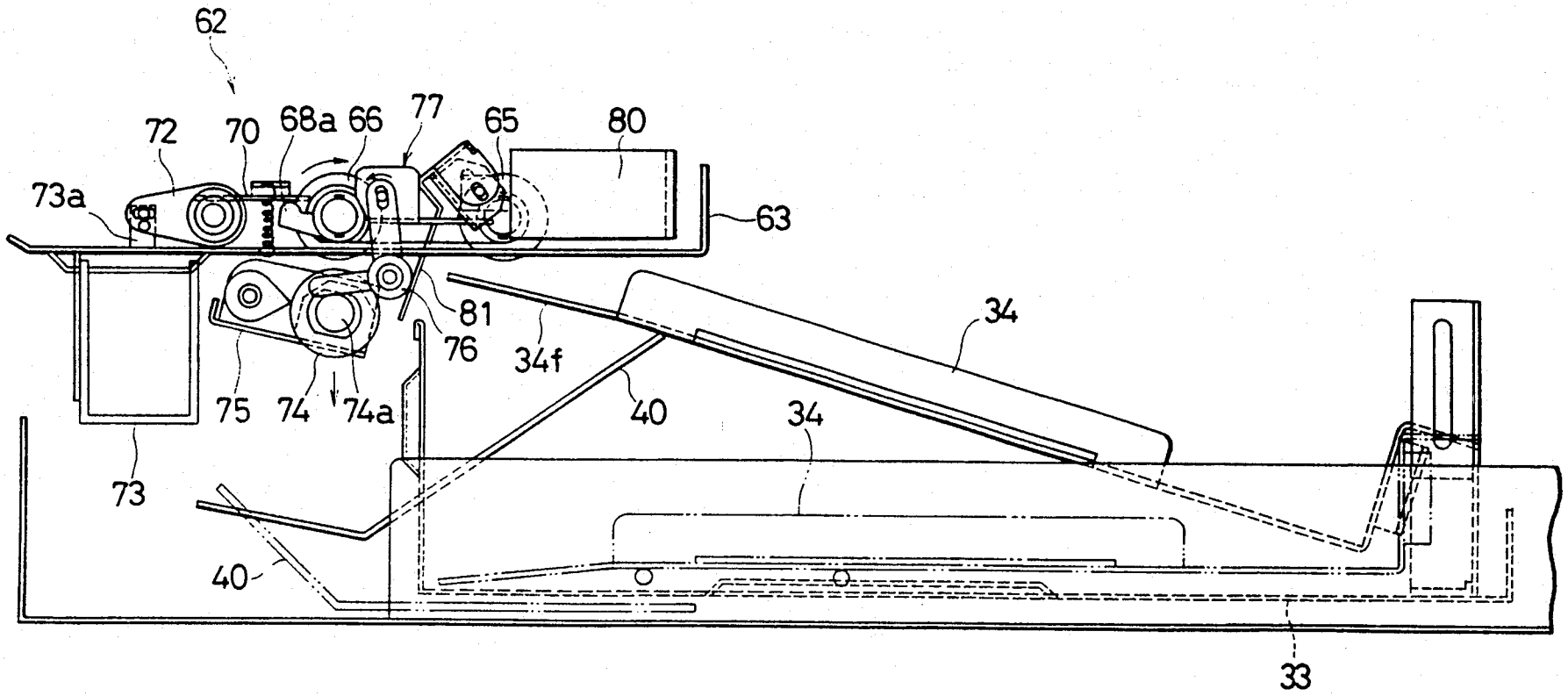
Figure 8A:
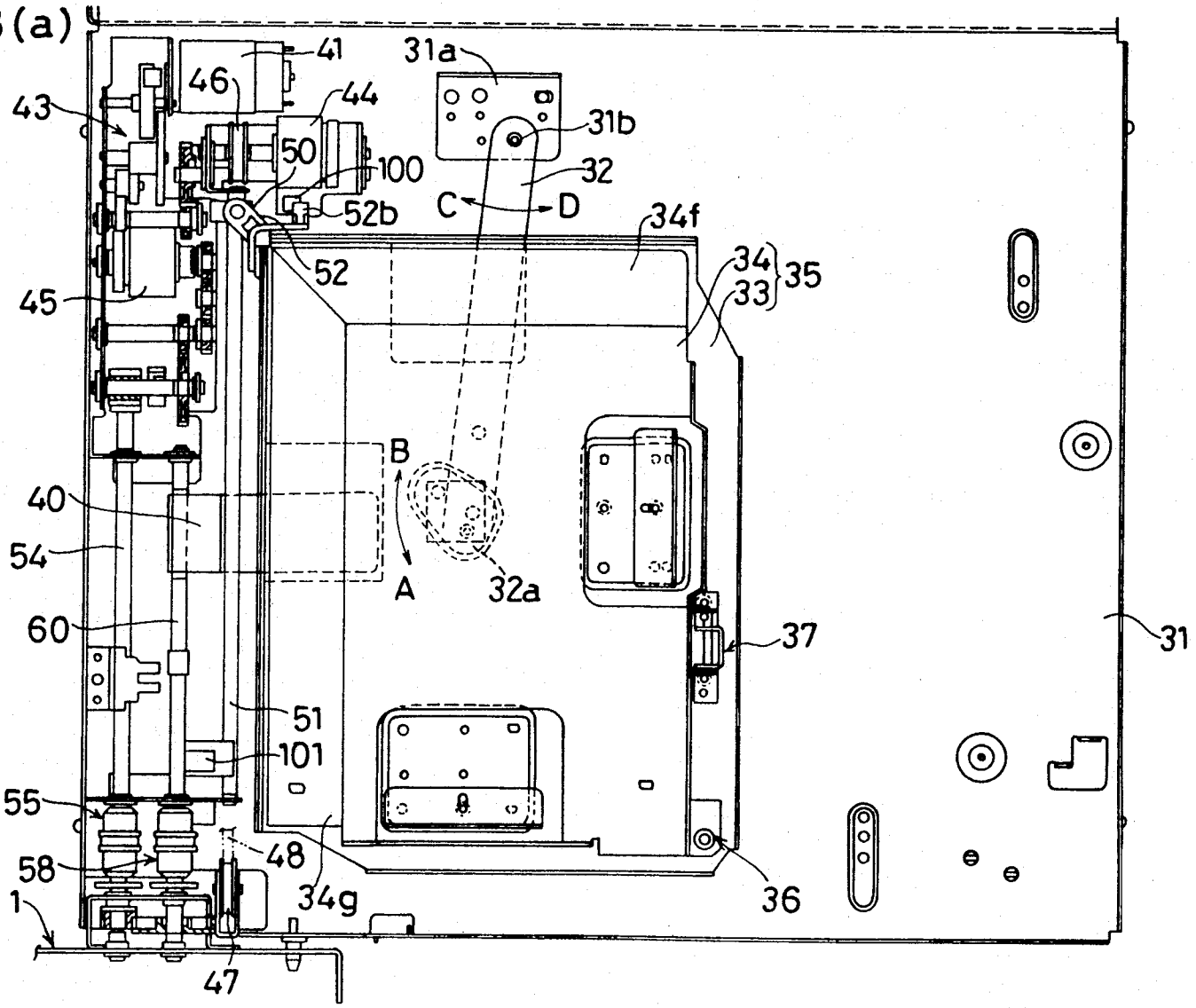
Figure 8B:
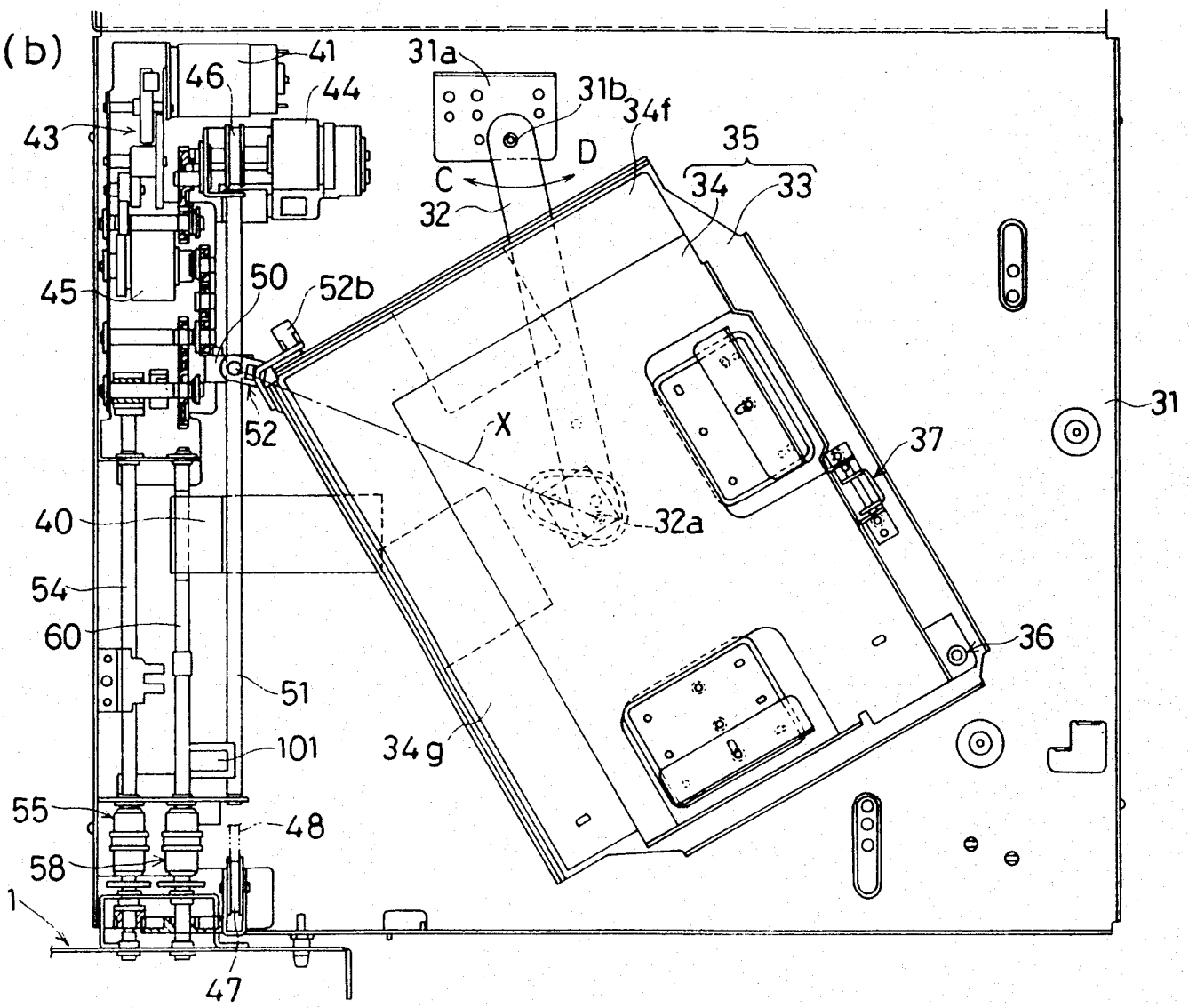
Figure 8C:
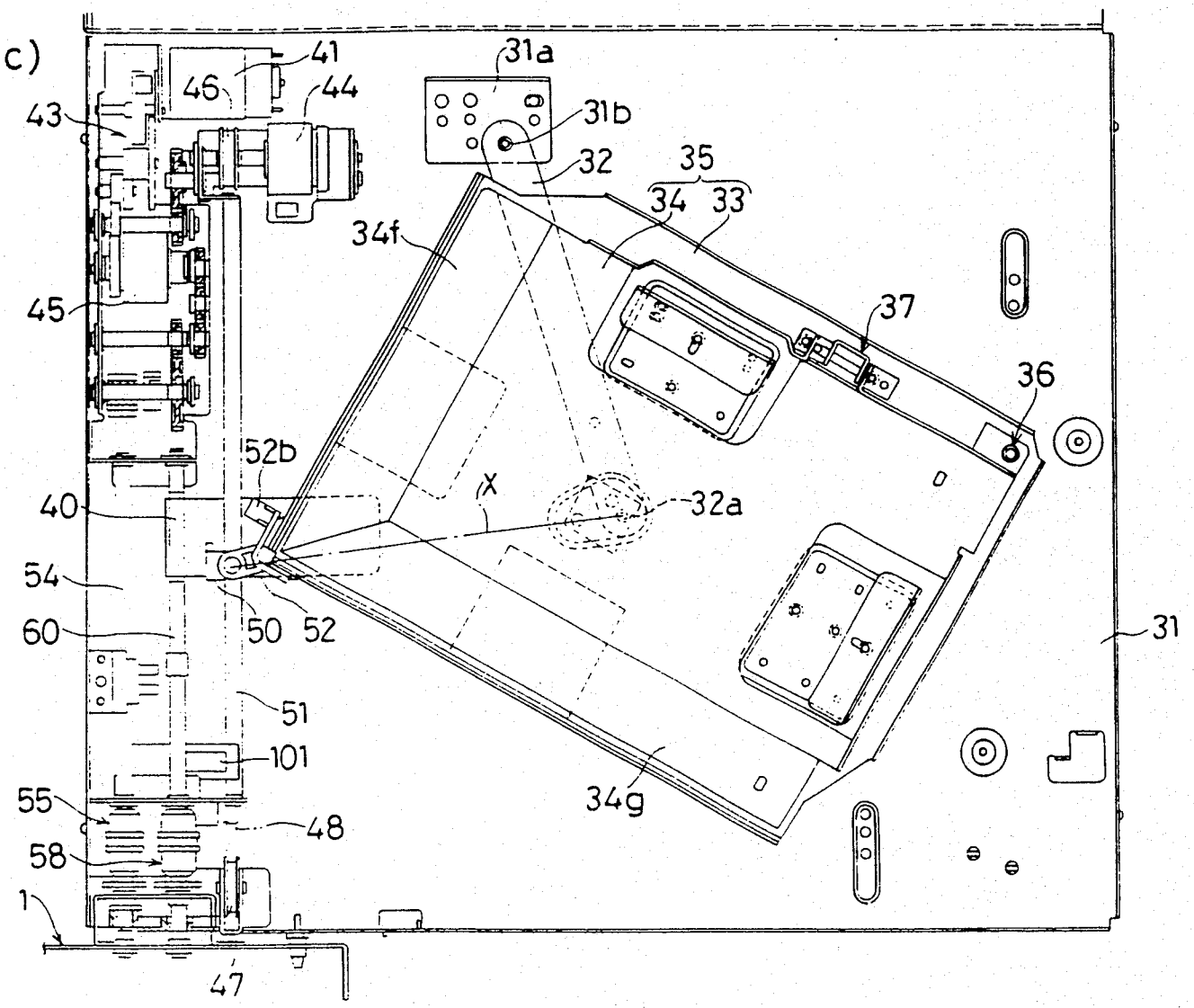
Figure 8D:
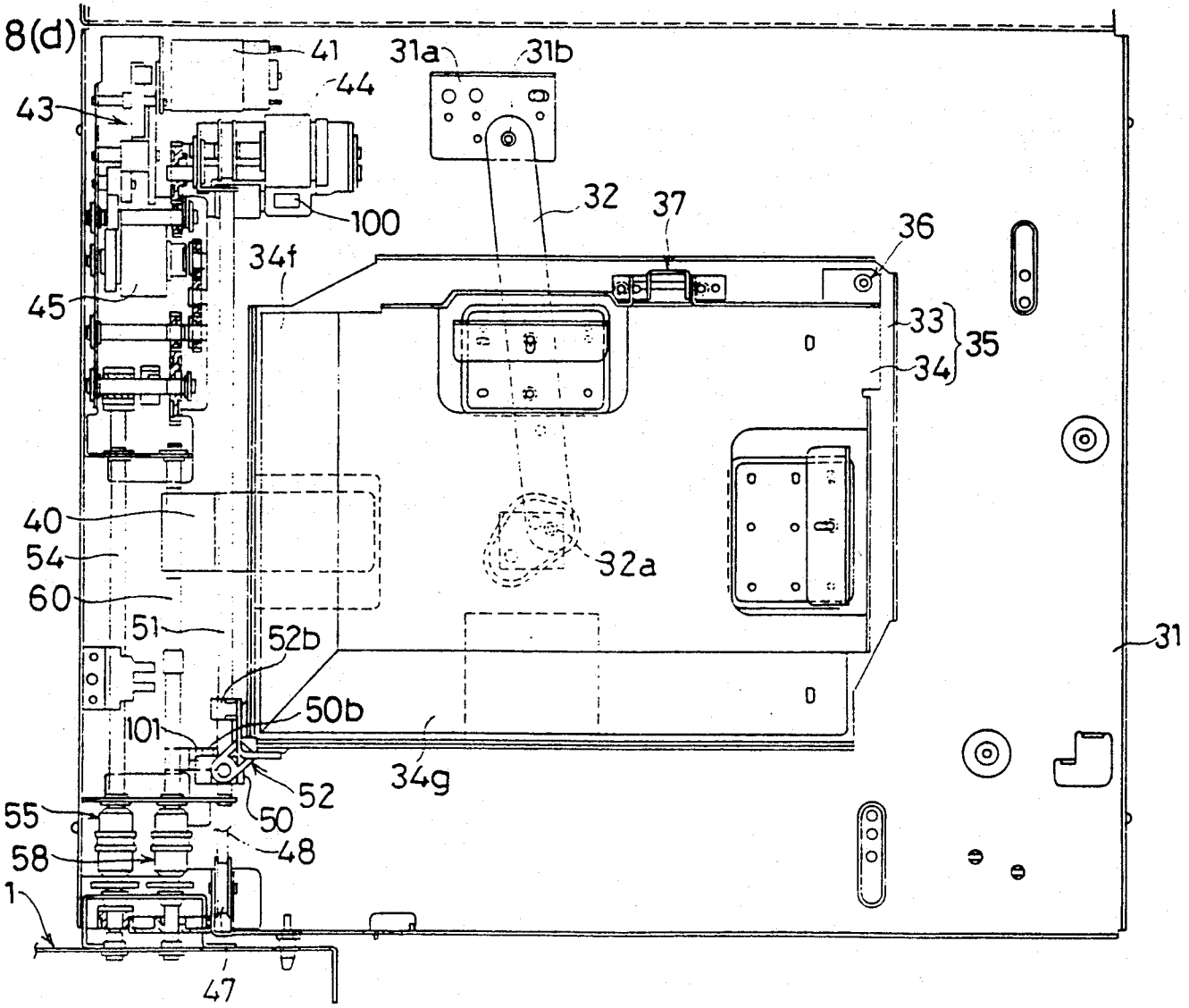

As illustrated in FIGS. 7(*a*) and (*b*), a mounting member 75 is disposed below the feeding roller 66. On the mounting member 75 there is mounted a reversing roller 74 that conveys the copy paper back by rotating in the same direction as the feeding roller 66. The mounting member 75 is designed such as to be capable of pivoting upwards and downwards thereby permitting the reversing roller 74 to approach or move away from the feeding roller 66. A rotation shaft 74*a* that transmits the rotation force to the reversing roller 74 is disposed below and in parallel with the rotation shaft 66*a* of the feeding roller 66. The actuating segment 76*a* of a pressure release lever 76 that is approximately formed in an L shape, is fitted between the rotation shaft 66*a* and the rotation shaft 74*a*. The pressure release lever 76 is mounted so as to be capable of pivoting vertically about a shaft 76*c*. When pivoting downwards, the pressure release lever 76 pushes the reversing roller 74 thereby causing the reversing roller 74 to move away from the feeding roller 76.

A coupling segment 76*b* mounted on the pressure release lever 76 is connected to one edge 77*a* of a pressure release coupling member 77 that pivots horizontally about a shaft 77*c* (shown in FIG. 6) and thereby permits the pressure release lever 76 to pivot. The other edge 77*b* of the pressure release coupling member 77, is connected to a pin of an actuating shaft 80*a* comprised in a paper pushing back solenoid 80. The progressing and recessing action of the actuating shaft 80*a* enables the pressure release coupling member 77 to pivot.

The actuating shaft 80*a* of the paper pushing back solenoid 80 is linked to the paper pushing back member 81 used for sending the copy paper back in the rotating section 35. The paper pushing back member 81 is installed between the pick-up roller 65 and the feeding roller 66 such as to be capable of pivoting in the vertical plane using a shaft 81*a* that is mounted upside from the position where the pin of the actuating shaft 80*a* is located, as a fulcrum. When the actuating shaft 80*a* is in a recessed state, the paper pushing back member 81 pivots in the direction that sends the copy paper back in the rotating section 35.

On each side of the pick-up roller 65 on the supporting board 63, there are installed a detection switch 82 for detecting whether the pivotal paper holding plate 34 is raised or not, and a copy paper detection switch 83 for detecting whether copy paper is stacked on the pivotal paper holding plate 34 or not. Actuating segments 82*a* and 83*a* disposed respectively on the switches 82 and 83 are mounted such as to project downwards through the opening 63*a* formed on the supporting board 63. Provision is made such that the actuating segment 82*a* of the switch 82 is actuated when pressed by the paper feeding section of the pivotal paper holding plate 34 that is in a raised state, while the actuating segment 83*a* of the switch 83 is actuated when pressed by the copy paper stacked on the pivotal paper holding plate 34 that is in a raised state. Also, an opening (not shown) is formed on the longitudinal paper feeding section and on the lateral paper feeding section of the pivotal paper holding plate 34 in a position that corresponds to the position of the actuating segment 83*a* of the copy paper detection switch 83. When there is no copy paper on the pivotal paper holding plate 34, the actuating segment 83*a* passes through the opening without turning the detection switch 83 ON, and only the detection switch 82 turns ON. On the other hand, when copy paper is stacked on the pivotal paper holding plate 34, both detection switches 82 and 83 turn ON.

The motion process of the rotating section 35 when the rotating section 35 moves from the lateral feed position to the longitudinal feed position, will be described hereinbelow with reference to FIGS. 8(*a*) through (*d*).

As illustrated in FIG. 8(*a*), when the rotating section 35 is set in the lateral feed position, the lateral feeding section thereof is positioned in the feeding section side of the rotatable cassette 26 (27). In this situation, the moving block 50 and the sustaining member 52 that constitute the moving means, are positioned at one edge of the guide shaft 51.

When the driving force from the driving motor 41 is transmitted to the pulley 46 through the first clutch 44, the pulley 46 rotates causing the belt 48 to start rotating. The moving block 50 that is attached to the belt 48 thus shifts toward the other edge guided by the guide shaft 51, as illustrated in FIG. 8(*b*).

The linear motion of the moving block 50 causes the rotating section 35 to rotate in the direction A. Here, as the rotating section 35 is linked to the moving block 50, and as the moving block 50 moves linearly, the center of rotation for the rotating section 35 shifts. The shift of the center of rotation is performed through the arm 32 that rotatably supports the rotating section 35, as the arm 32 pivots about the pivot pin 31*b* in the direction D. The arm 32 pivots in the direction D until a line X that joins the pivot pin 50*a* of the moving block 50 and the pivot pin 32*a* forms an angle of 90° with the guide shaft 51.

As illustrated in FIG. 8(*c*), when the angle formed by the above line X and the guide shaft 51 is greater than 90°, the rotating section 35 still rotates in the direction A, however the arm 32 then pivots in the direction C. Then, as illustrated in FIG. 8(*d*), when the moving block 50 reaches the edge of the guide shaft 51, the position sensing switch 101 is actuated by the switch actuating segment 50*b* of the moving block 50. The actuation of the position sensing switch 101 is sensed by the control unit of the copying machine 1 that cuts off the transmission of the driving force by means of the first clutch 44 causing the motion of the moving block 50 to stop. In this state, the longitudinal feeding section of the rotating section 35 faces the paper feeding side of the rotatable cassette 26 (27).

On the other hand, when the rotating section 35 moves from the longitudinal feed position to the lateral feed position, the driving motor 41 is reversed and the operation described above is executed in the reverse order. The switch actuating segment 52*b* of the sustaining member 52 actuates the position sensing switch 100 at the same time that the rotating section 35 is positioned in the lateral feed position. The actuation of the position sensing switch 100 is sensed by the control unit of the copying machine 1 that cuts off the transmission of the driving force by means of the first clutch 44 causing the motion of the moving block 50 to stop.

Here, the edge of the longitudinal paper feeding section when the rotating section 35 is placed in the longitudinal feed position due to the above rotation, and the edge of the lateral paper feeding section when the rotating section 35 is placed in the lateral feed position, are located in the same position. As a result the distance between the feeding mechanism 62 and the edges of the feeding sections in the different feed positions may be maintained constant. Therefore, there is no need to add a device for moving the feeding cassette or the pick-up roller, and the configuration of the overall device may be thus simplified and the cost reduced.

In addition, in the present embodiment, the shift of the moving block 50 is performed by means of the belt 48, whereby the moving block 50 may be moved rapidly and the change to the different positions may be executed promptly. The time the operator has to wait may be thus reduced to the minimum.

The lifting process of the paper feeding section of the pivotal paper holding plate 34 will be described hereinbelow. The driving force of the motor 41 is transmitted due to the operation of the second clutch 45 to the group of gears 53, the rotation shaft 54, the first coupling 55, the rotation shaft 56, the rotation shaft 57, the second coupling 58 and the lift-up shaft 60 in that order. The lift member 40 pivots in response to the rotation of the lift-up shaft 60. When pivoting upwards, the lift member 40 penetrates through the opening 33*c* formed on the feeding base 33, hits the bottom of the pivotal paper holding plate 34 and lifts the paper feeding section of the pivotal paper holding plate 34 up.

When the longitudinal feeding section of the pivotal paper holding plate 34 is lifted, the pivotal paper holding plate 34 is guided in the vertical direction by means of the guide bar 37*a* whose motion is restricted by the long holes 37*c* and that can move only in the vertical direction. Meanwhile, when the lateral paper feeding section of the pivotal holding plate 34 is lifted, the guide bar 37*a* is placed at the lower edges of the long guide holes 37*c* and rotates, thereby forming the fulcrum of the pivotal paper holding plate 34, together with the flexible joint described earlier.

Here, the supporting member 36 that supports the pivotal paper holding plate 34 at one point thereof, prevents the position of the pivotal paper holding plate 34 from being shifted (shift in the horizontal direction), and permits the copy paper to be sent forward without being shifted during the feeding operation performed after the pivotal paper holding plate 34 was pivoted and raised. In addition, the guiding means 37 prevents the pivotal paper holding plate 34 from moving horizontally whereby the copy paper may be prevented from being sent forward in a slantwise manner and the number of defective paper feeds may be reduced. The guiding means 37 also enables the pivoting process of the pivotal paper holding plate 34 to be performed smoothly and accurately.

In the present embodiment, the semi-spherical protrusion of the male joint 36*c* is fitted into the semi-spherical recession of the female joint 36*b*, thereby permitting the pivoting operation of the pivotal paper holding plate 34 to be performed due to the articulated motion of the flexible joint. As the flexible joint, for example a ball joint may be used.

The supporting member 36 that comprises the flexible joint formed by the female joint 36*b* and the male joint 36*c*, prevents the position of the pivotal paper holding plate 34 from being shifted (shift in the horizontal direction), and permits the copy paper to be sent forward without being shifted during the feeding operation performed after the pivotal paper holding plate 34 was pivoted and raised.

When the pivotal paper holding plate 34 is lifted up in the manner described above, the copy paper stored on the carrying part 34*h* passes on the longitudinal or lateral feeding section of the pivotal paper holding plate 34, is caught by the pick-up roller 65 and is further sent by the feeding roller 66 in the paper feeding path 22.

As the pivotal paper holding plate 34 is accommodated with the first inclined part 34*f* that declines forward and is formed in the longitudinal paper feeding section, and the second inclined part 34*g* that declines forward and is formed in the lateral paper feeding section, the copy paper stacked on the pivotal paper holding plate 34 may be thus forwarded in a feed direction that fits the feeding mechanism 62, when either the longitudinal feeding section or the lateral feeding section of the pivotal paper holding plate 34 is raised. Accordingly, the feeding operation may be carried out adequately after the pivotal paper holding plate 34 is raised.

Figure 9:
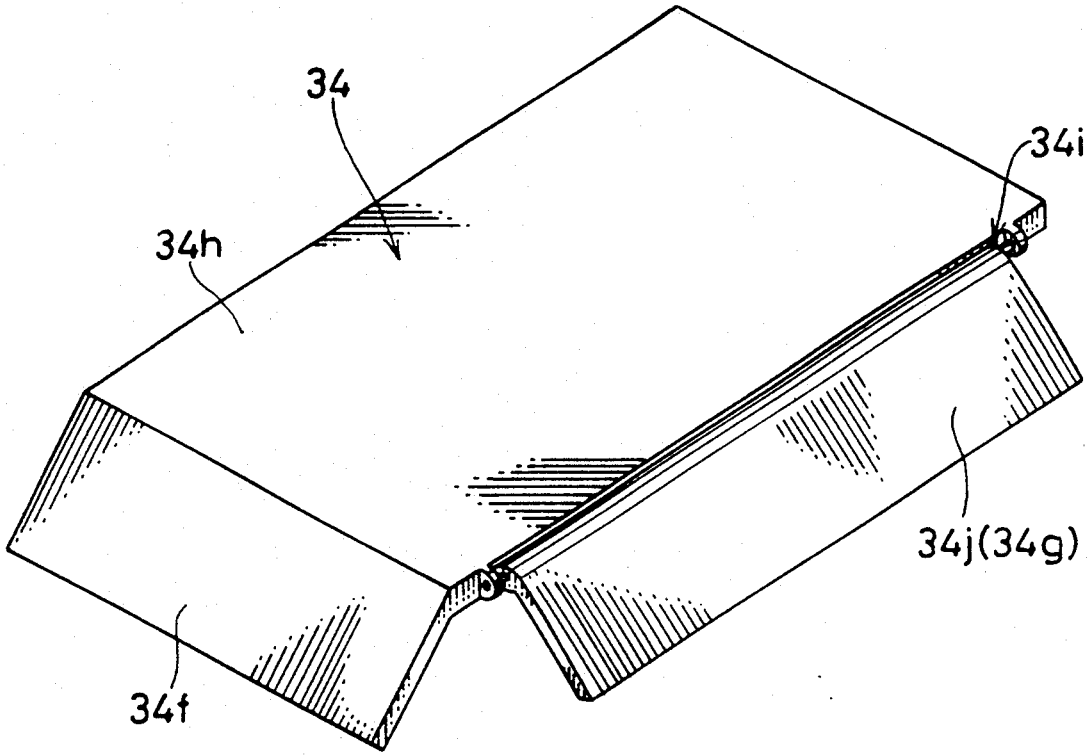
Figure 10:
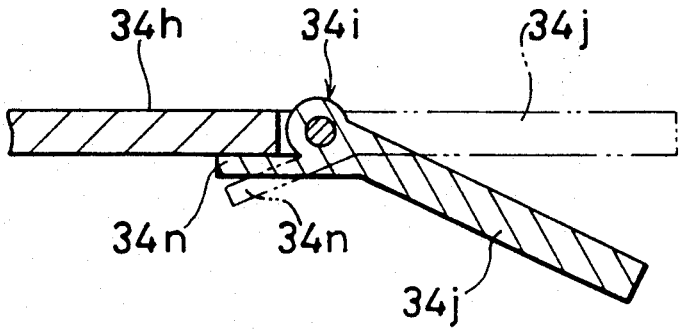

The inclined parts 34*f* and 34*g* of the pivotal paper holding plate 34 may be, for example, fabricated integrally with the carrying part 34*h* through drawing. Or, as illustrated in FIG. 9, the second inclined part 34*g* may be composed of an inclined plate 34*j* connected to the carrying part 34*h* by a hinge 34*i*. As illustrated in FIG. 10, a stopper portion 34*n* that projects downward from the carrying part 34*h*, is accommodated at the rear edge of the inclined plate 34*j*. When the inclined plate 34*j* pivots by a prescribed angle, the stopper portion 34*n* hits the bottom of the carrying part 34*h* thereby controlling the angle by which the inclined plate 34*j* pivots.

With the present invention, the first inclined part 34*f* formed in the longitudinal paper feeding section and the second inclined part 34*g* formed in the lateral paper feeding section may be designed such as to have tilt angles most suitable for forwarding the copy paper. Namely, when lateral feed is executed, the tilt angle of the pivotal paper holding plate which needs to be large as the feed direction corresponds to the short side direction of the copy paper. In the present invention, the first inclined part 34*f* whose tilt angle may be small, is fabricated through for example a bending process, while the second inclined part 34*f* whose tilt angle is large is composed of the inclined plate 34*j* connected to the carrying part 34*h* by the hinge 34*i*. Optimum tilt angles may be thus secured without causing the manufacturing process of the pivotal paper holding plate 34 to be complex. When both inclined parts have mutually equal lengths, undesirable consequences arise, i.e. the second inclined part 34*g* whose tilt angle is large projects downwards causing only one side of the pivotal paper holding plate 34 to be in contact with the feeding base 33 installed below the pivotal paper holding plate 34 and the pivotal paper holding plate 34 to be as floating. However, with the present invention, as the second inclined part 34*g* is composed of the inclined plate 34*j* connected to the carrying part 34*h* by the hinge 34*i*, when the pivotal paper holding plate 34 is not in a raised state, the lower edges of both inclined parts 34*f* and 34*g* are located in the same plane. The condition where the pivotal paper holding plate 34 is as floating can be thus avoided.

Figure 11:
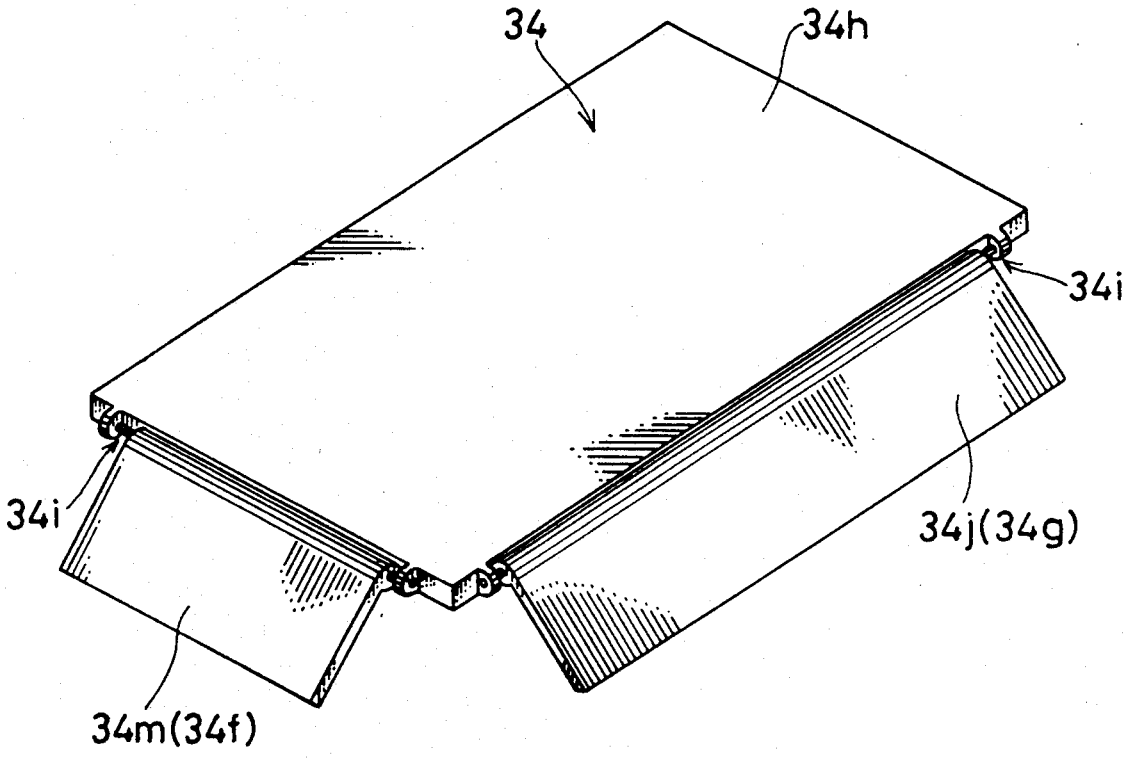

Also, the first inclined part 34*f* and the second inclined part 34*g* may be composed respectively of an inclined plate 34*j* and an inclined plate 34*m* that are each connected to the carrying plate 34*h* by a hinge 34*i*, as illustrated in FIG. 11. The angles by which the inclined plates 34*j* and 34*m* pivot, are controlled in the same manner as described earlier.

As described above with the present invention, optimum tilt angles may be secured for the inclined parts 34*f* and 34*g*. In addition both inclined parts 34*f* and 34*g* are provided with the inclined plates 34*j* and 34*m* that are connected by the hinges 34*i* to the carrying part 34*h*. This arrangement permits the carrying part 34*h*, the first and second inclined parts 34*f* and 34*g* of the pivotal paper holding plate 34 to be aligned in the same plane when the pivotal paper holding plate 34 is not in a raised state. The bottom of the pivotal paper holding plate 34 thus does not have to be in an elevated state and may be accommodated in a flat shape, enabling a greater quantity of copy paper to be stored.

Accordingly, with the present invention, the rotating section may be switched to an alternative feed position as required. In addition drawbacks such as a feeding device of a large size that it is equipped with a whole assortment of cassettes, or an overall device of a large size and a high cost and whose operation is complex as feeding cassettes need to be changed in accordance with the necessity, can be avoided. Moreover, the edge of the longitudinal paper feeding section and the edge of the lateral paper feeding section of the rotating section may be placed in a fixed position thereby eliminating the need for installing an additional device for moving the feeding cassette or the pick-up roller. The structure of the device may be thus simplified and its cost reduced.

Also, the copy paper stored on the pivotal paper holding plate may be forwarded in a feed direction that fits the feeding mechanism when either the longitudinal paper feeding section or the lateral paper feeding section of the pivotal paper holding plate is lifted. An adequate feeding operation may be thus carried out after the pivotal paper holding plate is raised. Further, shifts in the position of the pivotal paper holding plate may be prevented (shifts in the horizontal direction), and the copy paper may be prevented from being fed in a shifted position during the feeding operation performed after the pivotal paper holding plate was pivoted and raised.

In addition, the guiding means prevents the pivotal paper holding plate from moving in the horizontal plane and reduces the number of defective feeds by preventing the copy paper from being fed slantwise. Also the guiding means enables the pivotal paper holding plate to pivot smoothly and accurately.

The invention being thus described, it will be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A feeding device comprising:

an arm arranged such that one edge thereof is rotatably supported and wherein said arm is freely movable in a horizontal plane;

copy material orientation changing means whose axis is rotatably supported by the other edge of said arm, that is capable of rotating in the horizontal plane to at least two copy material feed positions, namely a longitudinal copy material feed position and a lateral copy material feed position and includes a vertically pivotal copy material holding plate;

a moving member for moving said copy material orientation changing means, said moving member being rotatably mounted in the proximity of a corner of said copy material orientation changing means and movable back and forth in a direction orthogonal to the copy material feed direction; and a flexible joint pivotable in at least two directions for supporting said pivotal copy material holding plate at one point located in the corner formed by a non-feeding side of said copy material orientation changing means when said copy material orientation changing means is set in said longitudinal feed position and a non-feeding side of said copy material orientation changing means when said copy material orientation changing means is set in said lateral feed position, such that said pivotal copy material holding plate uses said non-feeding sides as fulcrums when said pivotal copy material plate pivots and rises.

2. The feeding device as defined in claim 1, wherein said copy material orientation changing means further comprises at least a longitudinal copy material feeding section and a lateral copy material feeding section.

3. The feeding device as defined in claim 2, wherein said copy material orientation changing means further comprises a copy material feeding base on which said pivotal copy material holding plate is placed, and changes the feed position of the copy material stacked on said pivotal copy material holding plate by rotation by 90°.

4. The feeding device as defined in claim 3, further comprising guiding means, said guiding means including a sustaining member provided with vertically formed guide holes, and a guide member extending on one of the copy material non-feeding sides of said pivotal copy material holding plate, and engaged in said guide holes, said guide holes guiding said pivotal copy material holding plate when one of said copy material feeding sections of said pivotal copy material holding plate is being lifted, and acting as a fulcrum for said pivotal copy material holding plate when the other copy material feeding section of said pivotal copy material holding plate is being lifted.

5. The feeding device as defined in claim 1, wherein said arm includes a pivot pin, and wherein the position where said copy material orientation changing means is rotatably supported by said pivot pin is designed such that the center of the copy material stored in said copy material orientation changing means is located upon said pivot pin when said copy material orientation changing means is set in said longitudinal feed position and when said copy material orientation means is set in said lateral feed position.

6. The feeding device as defined in claim 2, wherein, said moving member comprises:

a guide shaft that extends in a direction orthogonal to the copy material feed direction, and a moving block provided with a through hole formed substantially in the center thereof;

said moving block being guided so as to move linearly along said guide shaft through said through hole.

7. The feeding device as defined in claim 6, wherein said moving block comprises:

a switch actuating segment for detecting the position of said copy material orientation changing means, and a pivot pin including a sustaining member disposed on the top of said moving block at a corner formed by said longitudinal copy material feeding section and said lateral copy material feeding section of said copy material orientation changing means, and further including a switch actuating segment for detecting the position of said copy material orientation changing means.

8. The feeding device as defined in claim 7, wherein said guide shaft comprises:

a position sensing switch installed in the proximity of one edge thereof for detecting the relocated position of said copy material orientation changing means when pressed by said switch actuating segment of said sustaining member.

and a position sensing switch installed in the proximity of another edge for detecting the relocated position of said copy material orientation changing means when pressed by said switch actuating segment of said moving block.

9. The feeding device as defined in claim 3, wherein said flexible joint includes:

a cylindrical supporting member mounted vertically on said copy material feeding base and that has a threaded hole, a female joint fixed on the top of said cylindrical supporting member and accommodated with a semi-spherical recession, and a male joint comprising a semi-spherical protrusion engaged in said recession;

said female joint and male joint each having a through-hole formed therein.

10. The feeding device as defined in claim 9 further comprising a coiled spring for maintaining said male joint and female joint in contact, and a bolt;

said bolt being screwed into said threaded hole formed in said cylindrical supporting member through said coiled spring, the through-holed of said male joint and the through-hole of said female joint.

11. The feeding device as defined in claim 10, wherein the through-hold of said male joint is formed substantially in the shape of a circular cone spreading downwards and wherein said male joint is able to move in an articulated manner without being hindered by said bolt.

12. The feeding device as defined in claim 2, wherein said pivotal copy material holding plate includes:

a carrying part where copy material is placed, a first inclined part accommodated in said longitudinal copy material feeding section and declines or is capable of declining downwards, and a second inclined part accommodated in said lateral copy material feeding section and declines or is capable of declining downwards.

13. The feeding device as defined in claim 12, wherein said first inclined part and said second inclined part are formed integrally with said carrying part.

14. The feeding device as defined in claim 12, wherein said second inclined part is composed of an inclined plate connected to said carrying part by a hinge.

15. The feeding device as defined in claim 12, wherein said first inclined part and said second inclined part are respectively composed of an inclined plate connected to said carrying part by a hinge.

16. The feeding device as defined in claim 14 or claim 15, wherein said inclined plate comprises a stopper portion that controls the angle by which said inclined plate pivots by hitting the bottom of said carrying part when said inclined plate is pivoted by a prescribed angle.

17. The feeding device as defined in claim 4, wherein said flexible joint is positioned on the axis of said guide member so that the rotation axis of said guide member when said guide member is positioned at the lower edges of said guide holes and the axis about which said flexible joint pivots coincide.

18. The feeding device as defined in claim 3, further comprising a lift member and a lift-up shaft arranged such that said lift member is fixed substantially in the central portion of said lift-up shaft, and such that said lift member pivots and hits the bottom of said pivotal copy material holding plate in response to the rotation of said lift-up shaft, thereby lifting said copy material feeding section of said pivotal copy material holding plate.

19. The feeding device as defined in claim 18, further comprising driving means for executing by means of a single motor the rotation of said copy material orientation changing means and the pivoting operation of said lift member that accompanies the lifting operation of the copy material feeding section of said pivotal copy material holding plate.

20. The feeding device as defined in claim 19, wherein said driving means comprises:

a first clutch for the transmission of the driving force used for rotating said copy material orientation changing means, and a second clutch for the transmission of the driving force used for pivoting said lift member when the cop material feeding section of said pivotal copy material holding member is being raised.

21. The feeding device as defined in claim 1, 2, 3 or 4, wherein said copy material is copy paper for use in copy machines and laser printers, and film for use in overhead projectors.

* * * * *